US006640060B2

(12) United States Patent
Yamaguchi et al.

(10) Patent No.: US 6,640,060 B2
(45) Date of Patent: Oct. 28, 2003

(54) IMAGE FORMING APPARATUS WITH DEVELOPER DENSITY AND REMAINING AMOUNT DETECTION

(75) Inventors: Seiji Yamaguchi, Shizuoka (JP); Masahide Kinoshita, Shizuoka (JP); Masao Uyama, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/201,219

(22) Filed: Jul. 24, 2002

(65) Prior Publication Data

US 2003/0021609 A1 Jan. 30, 2003

(30) Foreign Application Priority Data

Jul. 30, 2001 (JP) ..... 2001-230683
Jul. 30, 2001 (JP) ..... 2001-230685

(51) Int. Cl.[7] ..... G03G 15/08
(52) U.S. Cl. ..... 399/27; 399/30
(58) Field of Search ..... 399/27, 30, 58, 399/59, 62, 63, 64, 65

(56) References Cited

U.S. PATENT DOCUMENTS 6,381,419 B1 4/2002 Kinoshita et al. ..... 399/27
2002/0146252 A1 * 10/2002 Yamaguchi ..... 399/30

FOREIGN PATENT DOCUMENTS

JP 2001-13774 A * 1/2001

* cited by examiner

*Primary Examiner*—Joan Pendegrass
(74) *Attorney, Agent, or Firm*—Fitzpatrick, Cella, Harper & Scinto

(57) ABSTRACT

An image forming apparatus using a two-component developer including a toner and a carrier as a developer, and provided with a toner replenishing device for replenishing with the toner has remaining amount detecting means for detecting the remaining amount of toner in a toner container, and informing means for generating a signal indicative of a small remaining amount of toner when the remaining amount of toner in the toner container becomes equal to or less than a predetermined amount, and a limit value is made effective only in a state in which the signal indicative of a small remaining amount of toner is being outputted. Also, by the density of the developer in a developing container becoming smaller than a predetermined limit value, a state in which a developing device is not being replenished with the toner from the toner replenishing device is judged. The limit value has a plurality of standards, and a value is selected and used in conformity with the remaining amount of toner in the toner container.

20 Claims, 12 Drawing Sheets

IMAGE FORMING APPARATUS WITH DEVELOPER DENSITY AND REMAINING AMOUNT DETECTION

BACKGROUND OF THE INVENTION

1. Field of the Invention

This invention relates to an image forming apparatus such as a copying machine or a printer of the electrophotographic type, the electrostatic recording type or like type in which a developer is made to adhere to a latent image formed on an image bearing member to thereby visualize the latent image, and particularly to an image forming apparatus using a two-component developer including a toner and a carrier as a developer, and provided with a toner replenishing device for replenishing with the toner.

2. Description of Related Art

FIG. 13 of the accompanying drawings schematically shows the cross-sectional construction of an example of a developing device using a two-component developer including a toner and a carrier as a developer. FIG. 14 of the accompanying drawings shows the developing device of FIG. 13 as it is seen from above it.

In this example, the developing device 2 is provided with a developing container 10, and a developing sleeve 2A as a developer carrying member is provided in the opening portion thereof opposed to an image bearing member 1. A magnet roller 3 as magnetic field generating means is fixedly disposed in the developing sleeve 2A.

A screw 5 and B screw 6 as carrying and agitating means for carrying the developer to the developing sleeve 2A are disposed in the developing container 10. The A screw 5 and the B screw 6 are disposed substantially parallel to each other, and an inner wall 7 for partitioning the space between the A screw 5 and the B screw 6 is provided so that the developer may not come and go therebetween.

As will be understood from FIG. 14, the inner wall 7 is absent at the lengthwisely opposite end portions so that the developer can come and go between the A and B screws 5 and 6. The A screw 5 and the B screw 6 are adapted to carry the developer in opposite directions.

The developing sleeve 2A and the A screw 5 and the B screw 6 are connected together by gears (not shown) or the like, and when the developing sleeve 2A, the A screw 5 and the B screw 6 are rotated in the directions of arrows, the developer is uninterruptedly circulated therein as indicated by arrows in FIG. 14.

An inductance sensor 12 which is toner density detecting means is installed in proximity to the B screws 6. The two-component developer is basically comprised of a non-magnetic toner and a carrier having magnetism, and the magnetic permeability of the developer is determined by the amount of carrier occupying a predetermined volume. Therefore, the inductance sensor 12 is installed to measure the magnetic permeability of the developer to thereby measure the ratio between the toner and the carrier (hereinafter referred to as the "toner density").

Above the developing container 10 of the developing device 2, there is installed a toner replenishing device 9 for replenishing with a necessary amount of toner. A toner replenishing port 8 is located a little downstream of the inductance sensor 12, and when the toner is used for image formation and the toner density in the developer lowers, the amount of lowering of the toner density is measured when the developer passes the inductance sensor 12, and the developing container 10 is replenished with the necessary amount of toner from the toner replenishing device 9 through the toner replenishing port 8 and thus, the toner density in the developer is always kept constant.

As the toner density detecting means 12, use may be made of one of the optical density detection type, besides the inductance sensor described herein.

In a new developing device 2, there is prepared a standard developer adjusted in advance to predetermined toner density. When the new developing device 2 is set in an image forming apparatus, the agitating means 5 and 6 are rotated for a predetermined time and the developer uniformly pervades over the A screw 5 and the B screw 6 and the circulation of the developer becomes steady and the charged amount of the toner becomes settled. In this state, the measurement of the toner density is effected by the toner density detecting means 12. The value measured at this time is stored in a storing device (e.g. an EP-ROM free to write in or the like) mounted on the developing device, and is defined as a toner density reference value T inherent to this developing device.

During the control of the toner density during the printing operation, the difference between the measured value S and the aforementioned reference value T is compared, whereby it is possible to know How much the current toner density deviates as compared with the toner density of the standard developer and therefore, the amount of toner to replenish with can be calculated. By endowing the developing device with the toner density reference value T inherent to the developing device correspondingly to the developing device, toner density control optimum for each developing device 2 can be effected.

When the toner replenishment by the toner replenishing device 9 stagnates and the measured value S lowers and reaches a preset predetermined value (hereinafter referred to as the "limit value L"), it is judged that the developing device is not being replenished with the toner from the toner replenishing device 9, and the image forming apparatus is stopped and the supply of the toner to the toner replenishing device 9 is demanded.

In the above-described construction, however, the following problem has sometimes arisen with respect to the setting of the limit value L.

FIG. 12 of the accompanying drawings is an illustration showing an example of the transition of the measured value S, and the axis of abscissas indicates the number of prints and the axis of ordinates indicates the measured value S of the toner density.

During ordinary use, toner density control is effected so that the measured value S may converge around the vicinity of the reference value T. However, if high coverage images such as solid images are continuously printed, the toner in the developing device 2 will be rapidly consumed and therefore, the measured value S temporarily sharply lowers (Smin). Accordingly, unless the limit value L is set to a low level with a certain degree of safety rate foreseen with respect to Smin, the limit value L will be unexpectedly exceeded during the continuation of high coverage images or the like, and in spite of the presence of the toner in the toner replenishing device 9, the absence of the toner may be judged by mistake and the image forming apparatus may be stopped.

If in order to avoid such wrong detection, the limit value L is set to low developer density with the safety rate sufficiently given, the developer density will now become considerably low before the measured value S reaches the limit value L and therefore, the lowering of image density will occur and good images cannot be ensured. Also, image formation and agitation or the like are effected in a state in which the toner is little, namely, a carrier-rich state and therefore, the deterioration of the carrier progresses, and when the toner replenishing device 9 is replenished with the toner, if toner replenishment is effected at a stretch, fogged images may occur. If as described above, the limit value L is set too high, the possibility of effecting wrong detection will increase, and if the limit value L is set too low, the possibility of causing an inconvenience to images or the developing device will increase and therefore it has been very difficult to optimally set the limit value by the conventional construction.

Also, a single limit value L has always been used and therefore, it can be judged that the developing device is in a state in which it is not replenished with the toner from the toner replenishing device 9, but is has been impossible to discriminate whether it is the absence of the toner in the developing container 10, or the trouble of the toner replenishing device 9 (such as the badness of the toner discharging screws, the dogging of the replenishing port or the bad transmission by the gears) or the wrong detection in which the limit value L has been unexpectedly exceeded as during the continuation of high coverage images.

SUMMARY OF THE INVENTION

Accordingly, it is an object of the present invention to provide an image forming apparatus in which the detection of the absence of a toner in a toner replenishing device provided in a developing device is effected highly accurately and which is free of poor images and bad detection.

The above object is achieved by the image forming apparatus according to the present invention. Summing up, the present invention is an image forming apparatus provided with at least one developing device having a developing container for containing therein a developer including a toner and a carrier, means for detecting the density of the developer in the developing container, and a toner replenishing device provided with a toner container containing the toner therein and for replenishing the developing container with a proper amount of the toner in the toner container, wherein the absence of the toner in the toner container is judged by the density of the developer in the developing container becoming smaller than a predetermined limit value (L), characterized by remaining amount detecting means for detecting the remaining amount of toner in the toner container, and informing means for generating a signal indicative of a small remaining amount of toner when the remaining amount of toner in the toner container has become equal to or less than a predetermined amount, and in that the limit value (L) is effective only in a state in which the signal indicative of a small remaining amount of toner is being outputted.

The present invention adopts the above-described construction, whereby before the toner replenishing device outputs the remaining amount detection signal, even if the measured value S is below the limit value L, the absence of the toner is not judged and therefore, even if the density of the developer in the developing device is temporarily sharply lowered by the continuous printing of high density images or the like, such wrong detection that in spite of the presence of the toner in the toner replenishing device, the absence of the toner is judged by mistake can be prevented. Also, design is made such that the limit value L is made effective for the first time only after the toner replenishing device has outputted the remaining amount detection signal and therefore, it becomes possible to set the limit value L a little high, and the lowering of image density and the deterioration of the carrier due to the density of the developer having become too low can be prevented beforehand, and good images can be ensured till the last moment when the toner in the toner replenishing device becomes absent.

As described above, according to the present invention, an image forming apparatus provided with at least one developing device having a developing container for containing therein a developer including a toner and a carrier, means for detecting the density of the developer in the developing container, and a toner replenishing device provided with a toner container containing the toner therein, and for replenishing the developing container with a proper amount of the toner in the toner container, wherein the absence of the toner in the toner container is judged by the density of the developer in the developing container becoming smaller than a predetermined limit value (L), has remaining amount detecting means for detecting the remaining amount of toner in the toner container, and informing means for generating a signal indicative of a small remaining amount of toner when the remaining amount of toner in the toner container has become equal to or less than a predetermined amount, and is designed such that the limit value (L) is made effective only in a state in which the signal indicative of a small remaining amount of toner is being outputted and therefore, (1) Before the toner replenishing device outputs the remaining amount detection signal, even if the measured value S is below the limit value L, the absence of the toner is not judged and therefore, even if the density of the developer in the developing device is temporarily sharply lowered by the continuous printing of high density images or the like, such wrong detection that in spite of the presence of the toner in the toner replenishing device, the absence of the toner is judged by mistake can be prevented; and (2) Design is made such that the limit value L is made effective for the first time only after the toner replenishing device has outputted the remaining amount detection signal and therefore, it becomes possible to set the limit value L a little high, and the lowering of image density and the deterioration of the carrier due to the density of the developer having become too low can be prevented beforehand, and good images can be ensured till the last moment when the toner in the toner replenishing device becomes absent.

Accordingly, it is an object of the present invention to provide an image forming apparatus which can effect the detection of the absence of a toner and accident in a developing device provided with a toner replenishing device, without causing wrong detection and poor images.

The above object is achieved by the image forming apparatus according to the present invention. Summing up, the present invention is an image forming apparatus provided with at least one developing device having a developing container for containing therein a developer including a toner and a carrier, means for detecting the density of the developer in the developing container, and a toner replenishing device provided with a toner container containing the toner therein, and for replenishing the developing container with a proper amount of the toner in the toner container, wherein by the density of the developer in the developing container having become smaller than a predetermined limit value (L), it is judged that the developing container is not being replenished with the toner from the toner replenishing device, characterized in that the limit value (L) has a plurality of levels, and a value is selected and used in conformity with the remaining amount of toner in the toner container.

The present invention adopts the above-described construction, whereby before the toner replenishing device outputs a remaining amount detection signal, even if the measured value S is below the limit value L, the absence of the toner is not judged and therefore, even if the density of the developer in the developing container is temporarily sharply lowered by the continuous printing of high density images or the like, such wrong detection that in spite of the presence of the toner in the toner replenishing device, the absence of the toner is judged by mistake can be prevented. Also, design is made such that the limit value L is made effective for the first time only after the toner replenishing device has outputted the remaining amount detection signal and therefore, it becomes possible to set the limit value L a little high, and the lowering of image density and the deterioration of the carrier due to the density of the developer having becomes too low can be prevented beforehand, and good images can be ensured till the last moment when the toner in the toner replenishing device becomes absent.

Also, design is made such that different limit values L can be used properly in conformity with the remaining amount of toner in the toner container and therefore, it becomes possible to distinctively judge the absence of the toner in the toner container or the accident of the toner replenishing device or the like, and by effecting appropriate warning display, usability is greatly improved.

Thus, control partaking both of the accurate toner absence detection and inconvenience detection of the toner replenishing device can be realized by a simple construction.

According to the present invention, in an image forming apparatus provided with at least one developing device having a developing container for containing therein a developer including a toner and a carrier, means for detecting the density of the developer in the developing container, and a toner replenishing device provided with a toner container containing the toner therein, and for replenishing the developing container with a proper amount of the toner in the toner container, wherein by the density of the developer in the developing container having become smaller than a predetermined limit value (L), it is judged that the developing container is not being replenished with the toner from the toner replenishing device, design is made such that the limit value (L) has a plurality of levels, and a value is selected and used in conformity with the remaining amount of toner in the toner container and therefore, (1) Before the toner replenishing device outputs a remaining amount detection signal, even if the measured value S is below the limit value L, the absence of the toner is not judged and therefore, even if the density of the developer is temporarily sharply lowered by the continuous printing of high density images or the like, such wrong detection that in spite of the presence of the toner in the toner replenishing device, the absence of the toner is judged by mistake can be prevented;

(2) Design is made such that the limit value is made effective for the first time after the toner replenishing device has outputted the remaining amount detection signal and therefore, it becomes possible to set the limit value a little high, and the lowering of image density and the deterioration of the carrier due to the density of the developer having become too low can be prevented beforehand, and good images can be ensured till the last moment when the toner in the toner replenishing device becomes absent;

(3) Design is made such that different limit values are used properly in conformity with the remaining amount of toner in the toner container and therefore, it becomes possible to distinctively judge the absence of the toner in the toner container or the accident of the toner replenishing device or the like, and by effecting appropriate warming display, usability is greatly improved; and (4) Thus, control partaking both of the accurate detection of the absence of the toner and detection of the inconvenience of the toner replenishing device can be realized by a simple construction.

These and other objects, features, and advantages of the present invention will become more apparent upon consideration of the following description of the preferred embodiments of the present invention taken in conjunction with the accompanying drawings.

DETAILED DESCRIPTION OF THE PREFERRED EMBODIMENTS

An image forming apparatus according to the present invention will hereinafter be described in greater detail with reference to the drawings.

Embodiment 1-1

Figure 1:
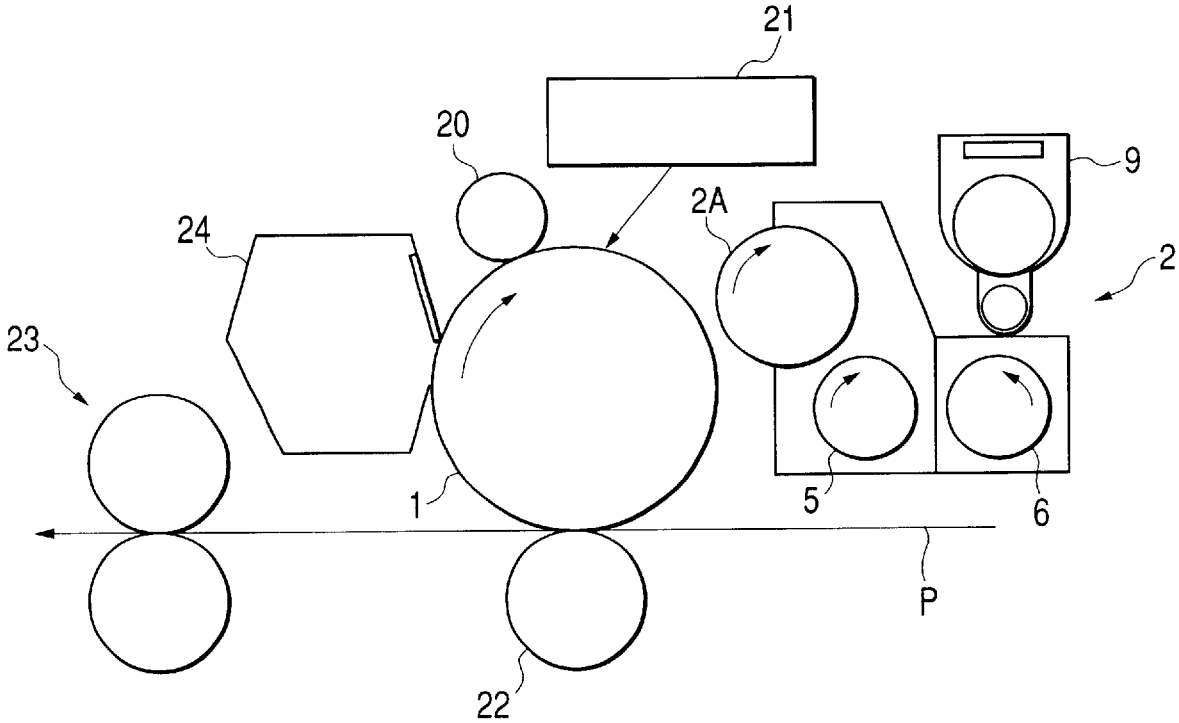
FIG. 1 schematically shows the construction of an embodiment of an image forming apparatus according to the present invention.

FIG. 1 schematically shows the construction of an electrophotographic image forming apparatus which is an embodiment of the image forming apparatus according to the present invention. The image forming apparatus according to the present embodiment has a drum-shaped electrophotographic photosensitive member, i.e., a photosensitive drum 1, which is an image bearing member. The photosensitive drum 1 is made rotatable in the direction of arrow, and around the photosensitive drum 1, there are disposed a charging apparatus 20 for uniformly charging the photosensitive drum 1, an exposing apparatus 21 for forming a latent image on the photosensitive drum 1, a developing device 2 for visualizing the latent image on the photosensitive drum 1 by a toner, a transferring apparatus 22 for transferring the visualized toner image onto a transferring material P, and a cleaning apparatus 24 for removing any untransferred toner remaining on the photosensitive drum 1. Also, the image forming apparatus is provided with a fixing apparatus 23 for fixing the toner image transferred onto the transferring material.

Figure 2:
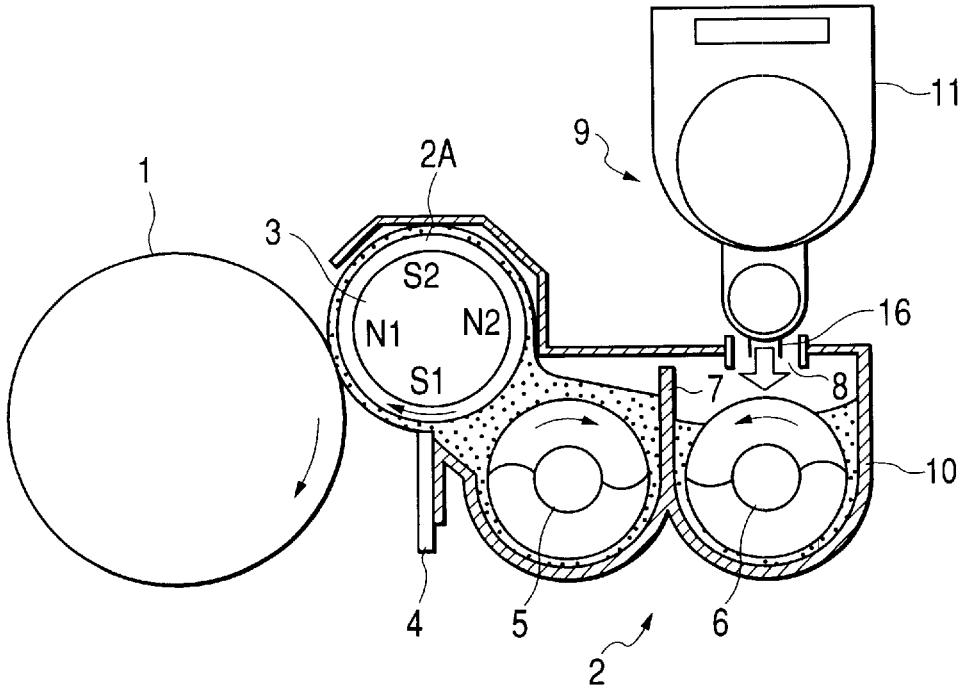
FIG. 2 schematically shows the construction of an embodiment of a developing device used in the image forming apparatus of the present invention.
Figure 3B:
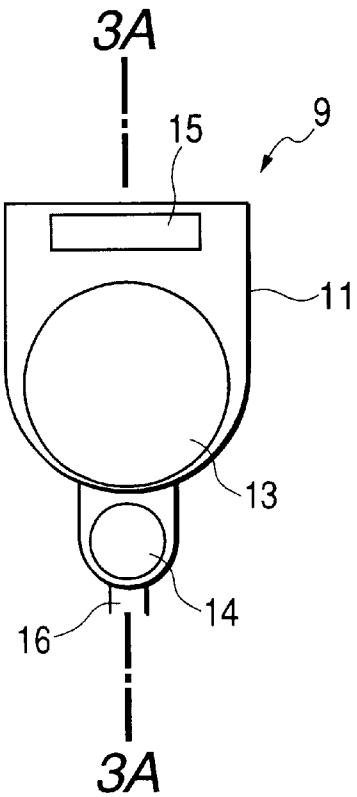
FIGS. 3A and 3B schematically show the construction of an embodiment of a toner replenishing device (toner cartridge) used in the image forming apparatus of the present invention.
Figure 3A:
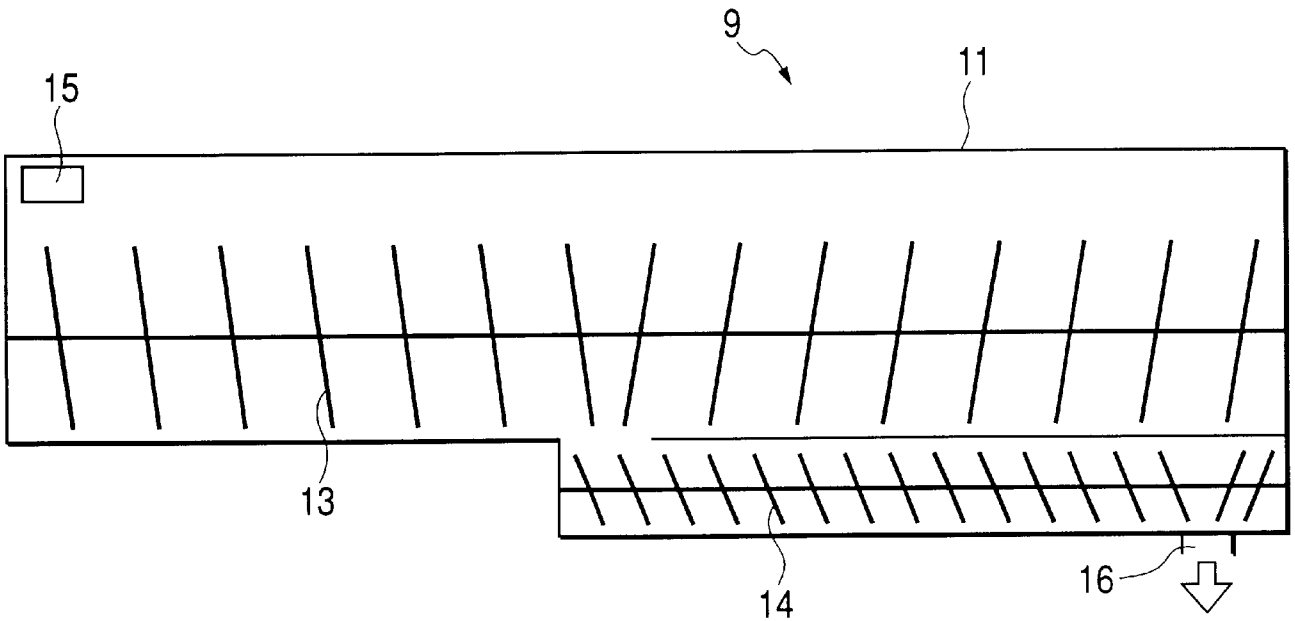

FIG. 2 shows the developing device 2 according to the present embodiment. A toner replenishing device 9 is installed on the developing device 2. In the present embodiment, the toner replenishing device 9, as shown in FIGS. 2, 3A and 3B, is a toner cartridge (T-CRG) detachably mountable to the developing device 2.

In FIG. 2, the developing device 2 is provided with a developing container 10 for containing a developer therein, and a developer comprising toner particles and magnetic carrier particles mixed together is contained in the developing container 10.

An opening portion is provided at a region of the developing container 10 which is proximate and opposed to the photosensitive drum 1, and a developing sleeve 2A which is a nonmagnetic developer carrying member made of aluminum, nonmagnetic stainless steel or the like is provided in this opening portion. The developing sleeve 2A is rotated in the direction of arrow to thereby carry the developer comprising the toner and carrier mixed together to a developing portion. The magnetic brush of the developer carried on the developing sleeve 2A contacts with the photosensitive drum 1 rotated in the developing portion, whereby the electrostatic latent image on the photosensitive drum 1 is developed.

The developing sleeve 2A is a hollow metal sleeve, and contains therein a magnet roller 3 which is magnetic field generating means. Two A and B screws 5 and 6 which are agitating means are installed in the developing container 10. The A screw 5 is disposed substantially parallel to the developing sleeve 2A, and the B screw 6 is disposed on a side opposite to the developing sleeve 2A with respect to the A screw 5. Above the B screw 6, the toner cartridge 9 is disposed detachably mountably to the main body of the image forming apparatus.

The toner cartridge 9 has a toner container 11 containing therein the toner for replenishment, an agitating device 13 for agitating the toner in the toner container 11, and a replenishing screw 14 for carrying the toner to the developing device 2 by a proper amount. There is a replenishing port 16 at the distal end of the replenishing screw 14, and in the image forming apparatus, this replenishing port 16 is connected to the toner replenishing port 8 of the developing device 2 and the developing device 2 is replenished with a necessary amount of toner. The toner container 11 and the replenishing screw 14 are partitioned by an inner wall and thus, the toner is carried toward the replenishing port 16 through a narrow passageway and therefore, the amount of toner discharged in conformity with the rotation of the replenishing screw 14 can be accurately adjusted as required.

As the toner, use can be made of a conventional one comprising binder resin with a coloring agent, a charging control agent or the like added thereto, and in the present embodiment, use is made of a toner having a volume average particle diameter of 5 to 15 $\mu$m. On the other hand, as the magnetic carrier, use may suitably be made of a ferrite carrier or a carrier provided with resin coating, and an average particle diameter of 15 to 70 $\mu$m is preferable.

As a remaining amount detecting device for the toner cartridge 9, use can be made of one of various methods such as light transmission type remaining amount detection and agitating torque detection, but in the present embodiment, use is made of a method of integrating the number of revolutions of the replenishing screw 14 and storing it in a nonvolatile memory (EP-ROM) 15 provided in the toner cartridge 9, and grasping the remaining amount of toner by the use of the total number of revolutions of the replenishing screw 14. The replenishing screw 14 is small in diameter and therefore, the amount of toner fed out thereby is substantially proportional to the number of revolutions, and the total number of revolutions is in a linear relational with the amount of toner replenishment and therefore, there is the advantage that the remaining amount of toner can be sequentially grasped. When the discharge of the toner progresses and the total number of revolutions has reached a predetermined value, "a small remaining amount of toner" is judged and a remaining amount detection signal becomes ON.

Figure 4:
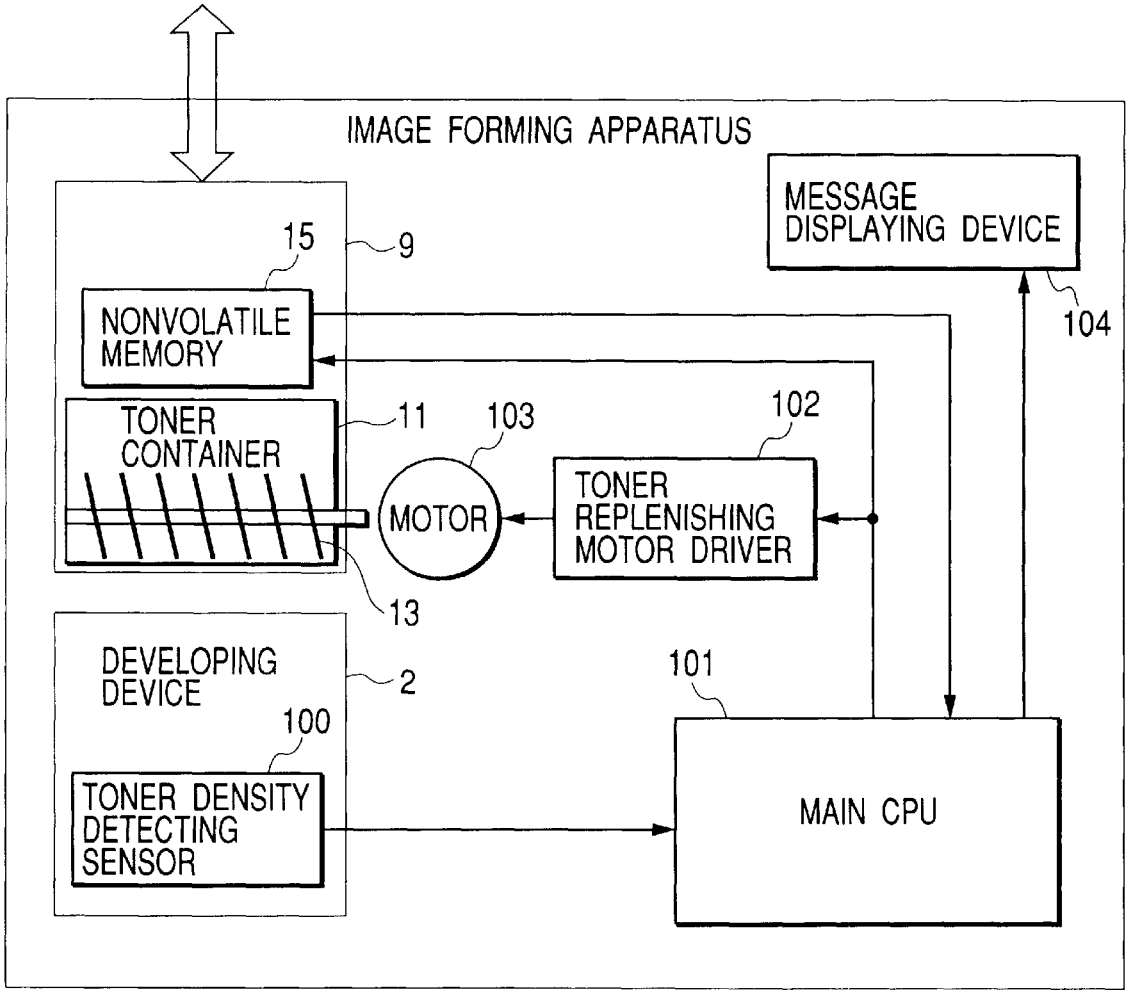
FIG. 4 is a block diagram showing the construction around a CPU in an embodiment of the image forming apparatus according to the present invention.

FIG. 4 is a block diagram showing the construction around the CPU of the image forming apparatus according to the present embodiment. Actually, the main CPU 101 is connected to the various units of the image forming apparatus such as the exposing apparatus (not shown) and the high voltage source (not shown) of the charging apparatus, and governs the operation of the entire image forming apparatus, but in FIG. 4, the other portions than portions forming the gist of the present invention are omitted to avoid cumbersomeness.

The main CPU 101 is connected to a toner density detecting sensor 100 provided in the developing device 2, and is designed to be capable of sequentially obtaining the toner density in the developing device 2. Usually during printing, control is effected so that a toner replenishing motor driver 102 may be controlled to thereby drive a toner replenishing motor 103 so that the toner density in the developing device 2 may become constant.

A nonvolatile memory 15 is mounted on the toner cartridge 9 designed detachably mountable to the main body of the image forming apparatus. The memory 15, when mounted on the image forming apparatus, is electrically connected to the main CPU 101 and becomes capable of reading and writing various kinds of information.

The main CPU 101 outputs a toner replenishment demand signal to the toner replenishing motor driver 102 and also adds a toner replenishing motor driving time and writes it into the nonvolatile memory 15. Thus, the summed-up driving time information of the toner replenishing motor 103 is given to the toner cartridge 9, whereby even if the toner cartridge is dismounted in the course of printing, the toner remaining amount information is reliably held in each cartridge because the summed-up driving time of the toner replenishing motor 103 is recorded in the nonvolatile memory 15 and therefore, the remaining amount of toner in the toner cartridge 9 can be recognized.

Figure 5:
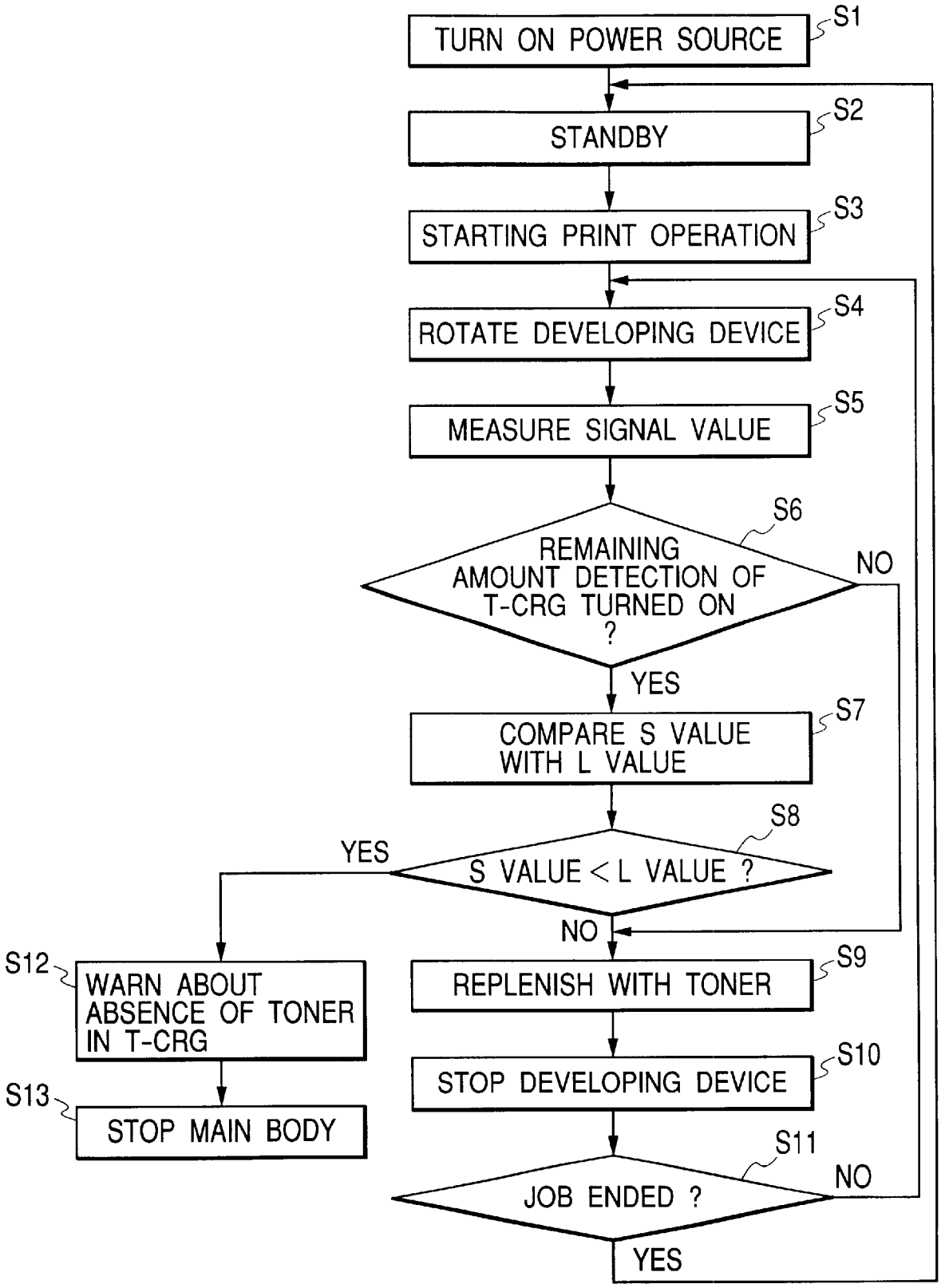
FIG. 5 is a flow chart of Embodiment 1-1 illustrating the operation of the image forming apparatus of the present invention.

Description will now be made of the operation of the image forming apparatus according to the present embodiment. FIG. 5 shows the operation of the image forming apparatus regarding toner replenishment, and specifically it is a flow chart of the operation executed by the main CPU 101 by the use of information obtained from the toner density detecting sensor 100 and the nonvolatile memory 15.

When a predetermined starting preparation is finished after the turn-on of the power source of the main body of the image forming apparatus (s1), a standby state (s2) is brought about. When a printing signal is received in the standby state, the printing operation is started and the photosensitive drum 1, the charging apparatus 20, the exposing apparatus 21, etc. are successively started (s3). The developing device 2 stands by while being stopped until the timing for developing comes, and the developing device 2 is rotated only when it effects development (s4). Simultaneously with the rotation of the developing sleeve 2A, the screws 5 and 6 in the developing container 10 are rotated to thereby start the agitation of the developer. At the right time when the rotation of the developing device 2 becomes steady, the exposing apparatus 21 is operated to thereby form a latent image and at the same time, the measurement of developer density is effected to thereby obtain a measured value (signal value) S (s5).

Next, reference is had to the remaining toner information of the toner cartridge (T-CRG) 9 (s6), and when the remaining amount detection signal is OFF, replenishment with toner is effected as is usual (s9). When the remaining toner information of the toner cartridge 9 is ON, comparison between the measured value S and the limit value L is effected (s7), and if the measured value S>the limit value L, replenishment with toner is effected as is usual (s9). Thereafter, after the latent image has completely passed the developing device 2, the developing device 2 is stopped (s10), and whether there are remainders of the job is judged (s11), and if there are still sheets to be continuously printed, the image forming apparatus enters the next cycle again, and if there are no remainders of the job, return is made to the standby state (s2).

If the measured value S<the limit value L, the absence of the toner in the toner cartridge is judged and the image forming apparatus effects the display of demanding he interchange of the toner cartridge (s12), and stops its operation (s13).

Figure 6:
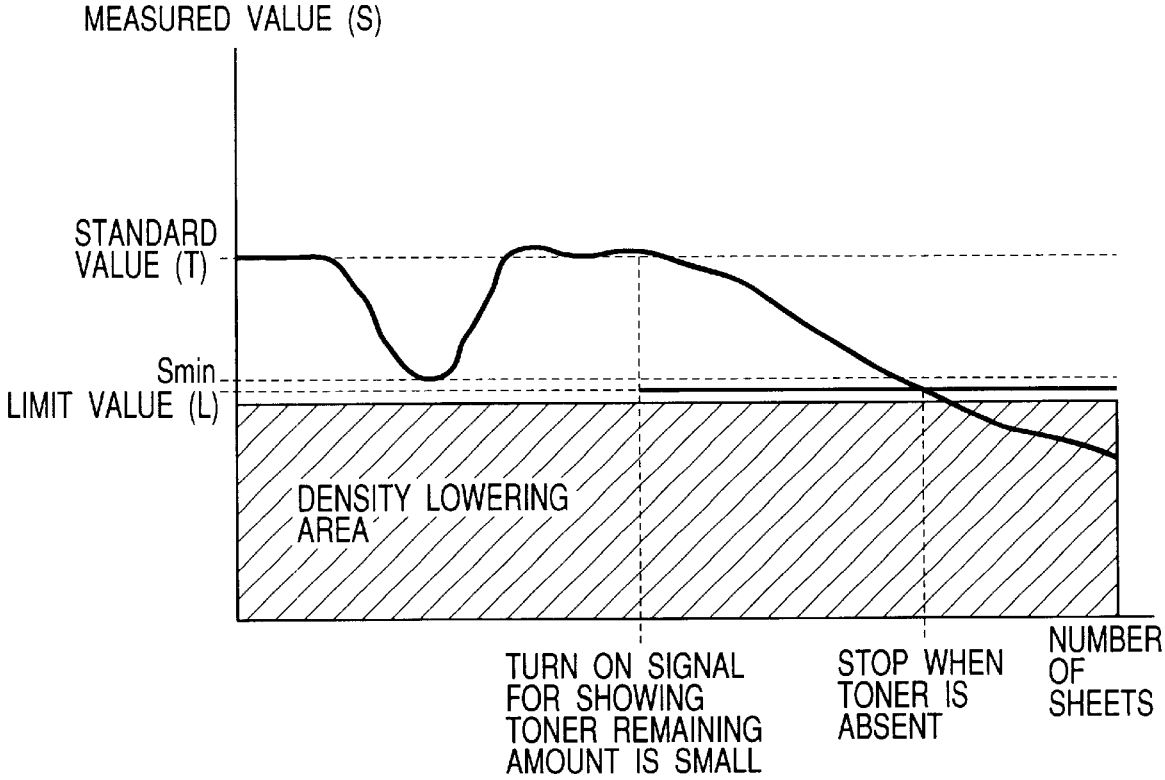
FIG. 6 is an illustration showing the transition of a signal value (measured value) S.
Figure 12:
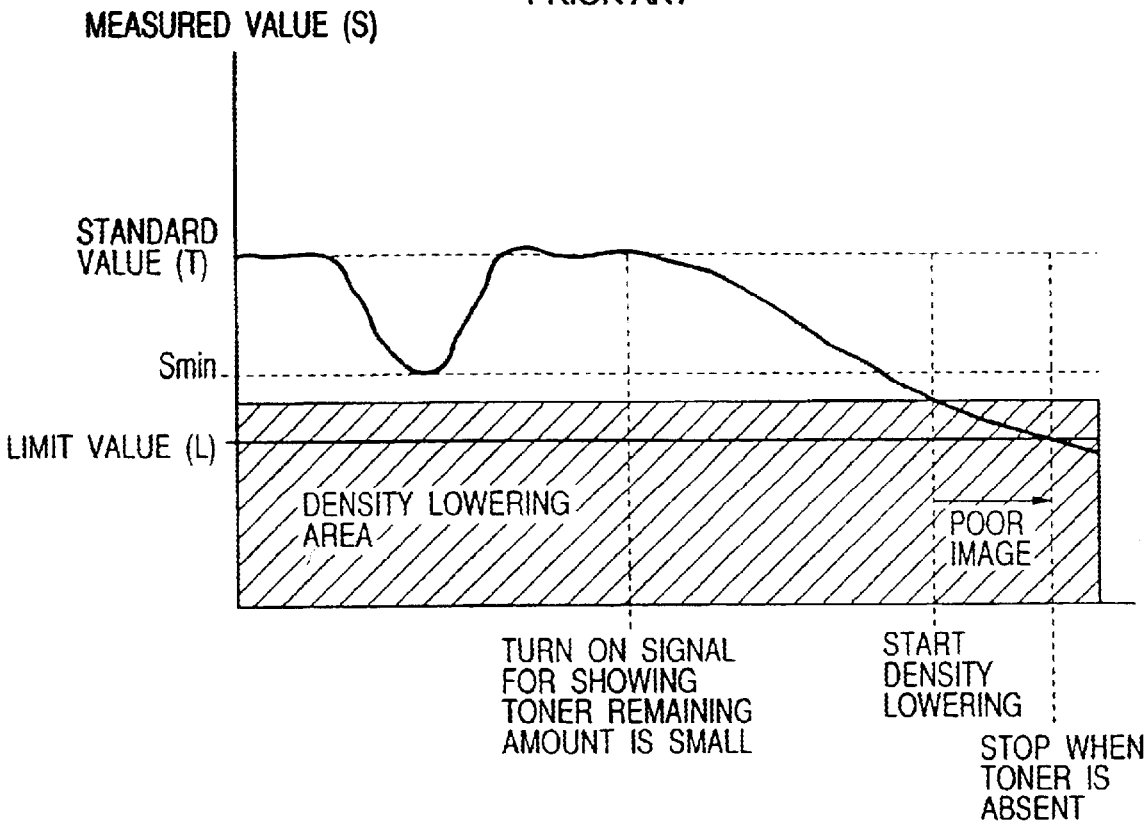
FIG. 12 PRIOR ART
FIG. 12 is an illustration showing the transition of a conventional signal value S.
Figure 13:
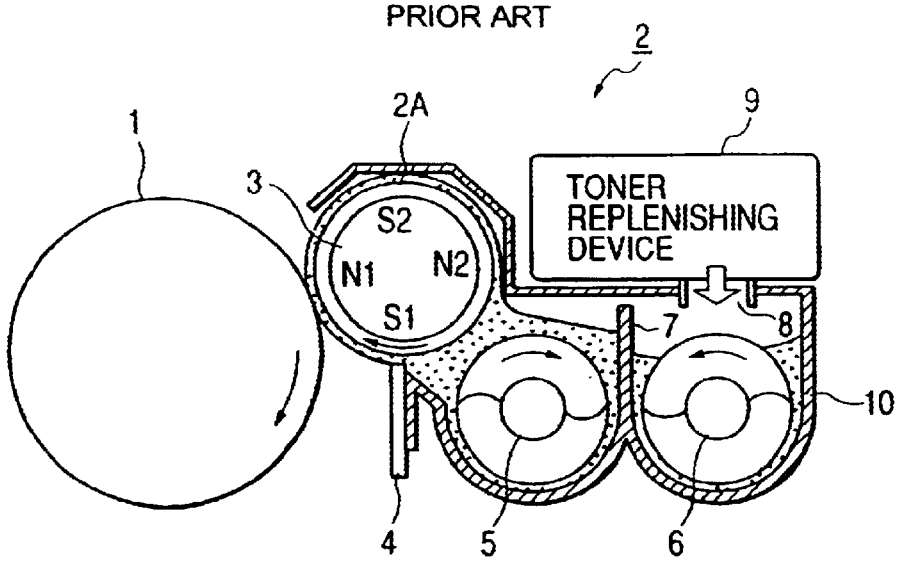
FIG. 13 PRIOR ART
FIG. 13 is a cross-sectional view of a conventional developing device.
Figure 14:
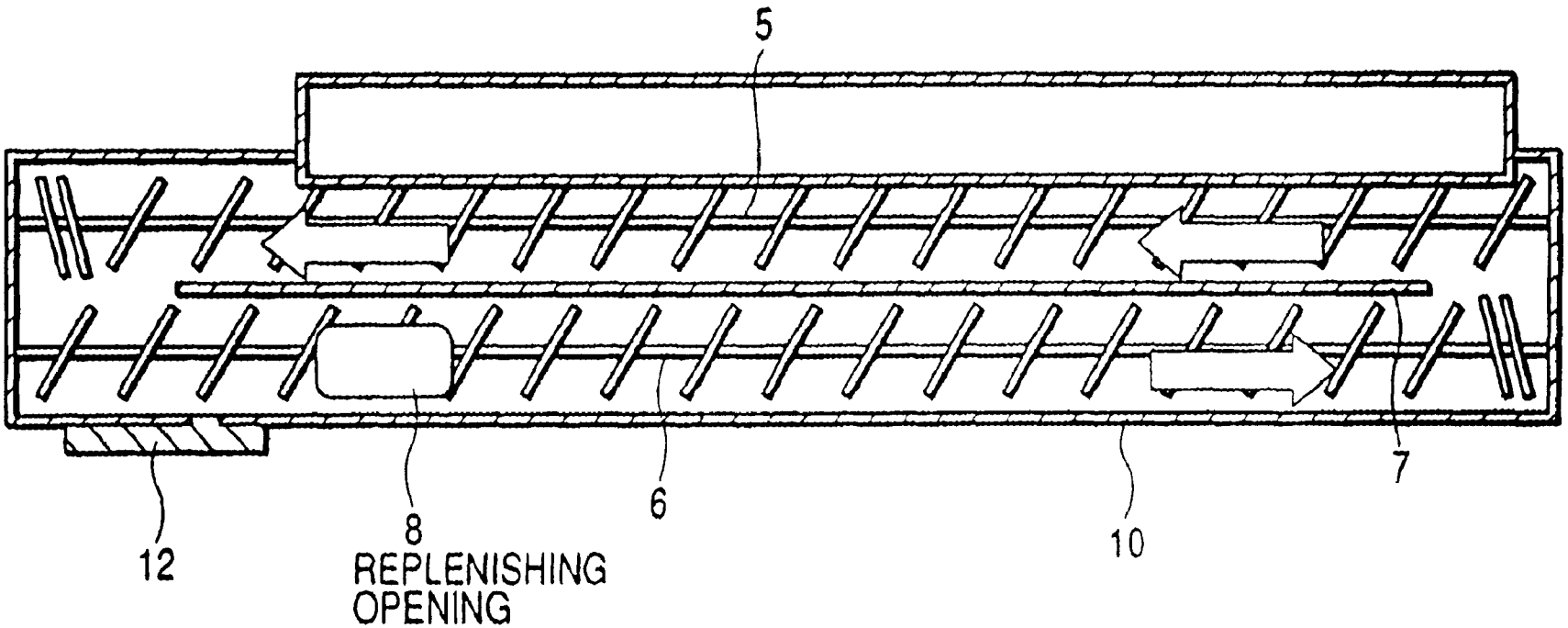
FIG. 14 PRIOR ART
FIG. 14 is a plan view of the conventional developing device.

FIG. 6, like FIG. 12 described in the related art, is a graph showing the transition of the measured value S in the above-described construction. As is apparent from FIGS. 6 and 12, in the present embodiment, unlike a case where a constant limit value is always effective, design is made such that on the basis of the information of the toner cartridge, the limit value is made effective only at the end of the life of the toner cartridge. By doing so, it becomes possible to set the limit value a little high, and the lowering of image density and the deterioration of the carrier due to the density of the developer having become too low can be prevented beforehand, and good images can be ensured till the last moment when the toner in the toner cartridge becomes absent.

Also, before the toner cartridge outputs the remaining amount detection signal, even if the measured value S is below the limit value L, the absence of the toner is not judged and therefore, even if the density of the developer in the developing container is temporarily sharply lowered by the continuous printing of high density images or the like, such wrong detection that in spite of the presence of the toner in the toner cartridge, the absence of the toner is judged by mistake can be prevented.

Embodiment 1-2

In Embodiment 1-1, description has been made of an example of the operation in which when the remaining amount detection information of the toner cartridge 9 is ON, comparison between the measured value S and the limit value L is effected, and if the measured value S<the limit value L, the absence of the toner in the toner cartridge 9 is judged, and the image forming apparatus effects the display of demanding the interchange of the toner cartridge 9 and stops its operation. In the other points, Embodiment 1-2 is similar to Embodiment 1-1 and need not be described in detail with regard to those points.

In the present embodiment, it is a feature that with a view to more highly accurately judge the absence of the toner in the toner cartridge, the frequency with which the measured value S<the limit value L has continuously occurred (hereinafter referred to as the "limit value exceeding frequency Z") is counted, and the absence of the toner in the toner cartridge is judged for the first time only when the limit value exceeding frequency Z exceeds 3.

Figure 7:
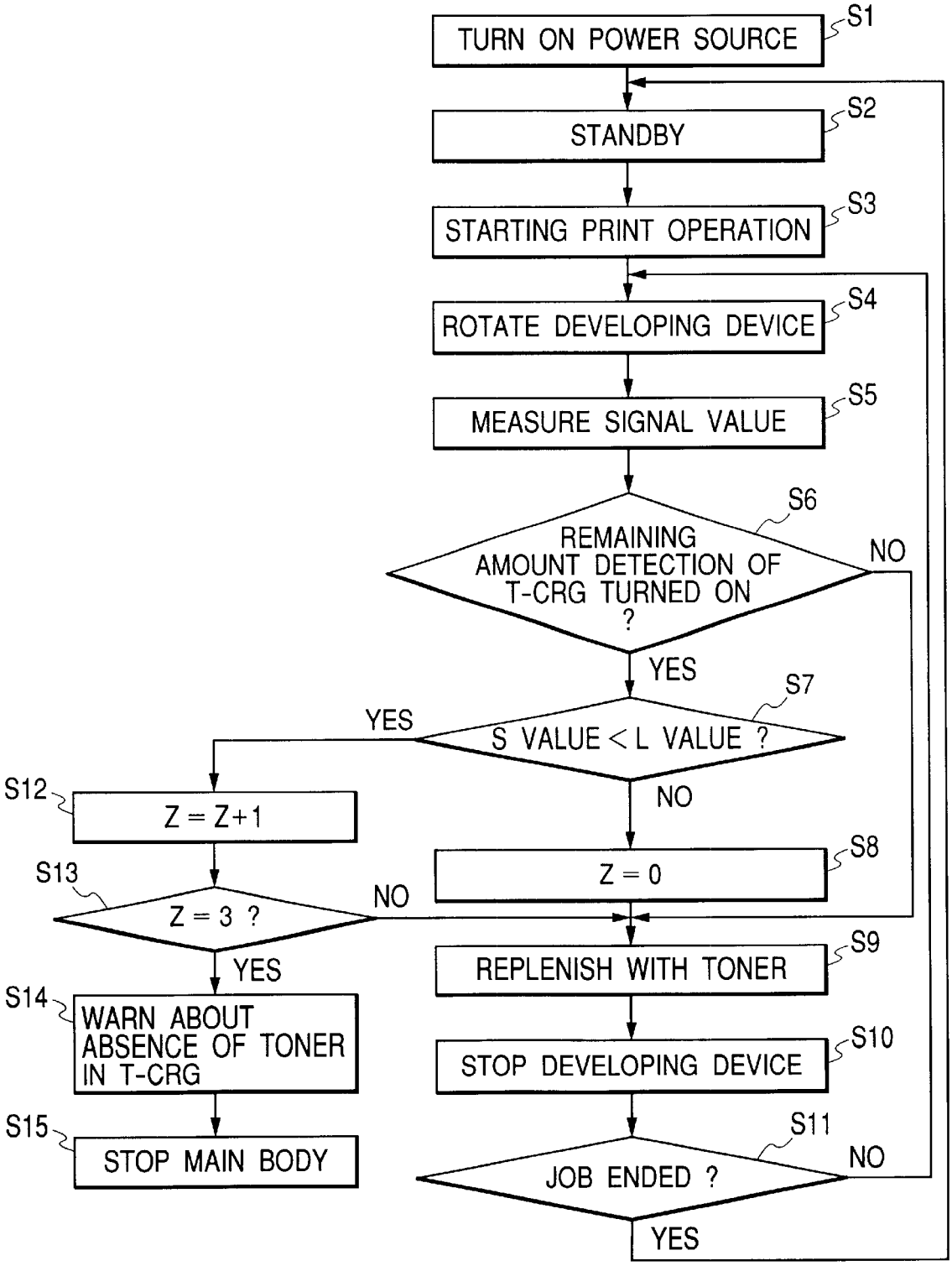
FIG. 7 is a flow chart of Embodiment 1-2 illustrating the operation of the image forming apparatus of the present invention.

FIG. 7 is a flow chart showing the operation of the image forming apparatus regarding the replenishment with the toner in the present embodiment. This flow chart is similar to the flow chart of Embodiment 1-1 up to the point that the power source is turned on (s1) and the measurement of the density of the developer is effected to thereby obtain the measured value (signal value) S (s5) and therefore, need not be described up to that point.

After the measured value S has been obtained, reference is had to the remaining toner information of the toner cartridge 9 (s6), and when the remaining amount detection signal is OFF, replenishment with the toner is effected as is usual (s9). When the remaining amount detection information of the toner cartridge is ON, comparison between the measured value S and the limit value L is effected (s7), and if he measured value S>the limit value L, the limit value exceeding frequency Z is reset to 0 (s8), and replenishment with the toner is effected as is usual. Thereafter, after the latent image has completely passed the developing device 2, the developing device 2 is stopped (s10), and whether there are remainders of the job is judged (s11), and if there are still sheets to be continuously printed, the image forming apparatus enters the next cycle again, and if there are no remainders of the job, return is made to the standby state (s2).

If the measured value S<the limit value L, 1 is added to the limit value exceeding frequency Z (s12), and whether the value of Z is 3 or less (s13). If the value of Z is 3 or less, the ordinary operation is continued, and the absence of the toner in the cartridge is judged for the first time only when Z=3, and the image forming apparatus effects the display of demanding the interchange of the toner cartridge (s14), and stops its operation (s15).

Design is made such that in a state in which by the operation as described above being performed, the remaining amount detection information of the toner cartridge becomes ON and the comparison thereof with the limit value L is effected, only when the measured value S<the limit value L is judged three times on end, the absence of the toner is judged and therefore, even if a low value is unexpected outputted due to the unevenness or the like of the measurement by the toner density detecting device, it never happens that the operation is stopped by mistake, and the factor for the unevenness can be eliminated, and it becomes possible to more precisely judge the absence of the toner in the toner cartridge. While in the present embodiment, the limit value exceeding frequency Z is set to 3, this is not restrictive, but Z may be set to other value.

Embodiment 2-1

Description will now be made of the operation of an image forming apparatus according to Embodiment 2-1 of the present invention. In the other points than those described hereinafter, this embodiment is similar to Embodiment 1-1 and need not be described in detail with regard to those points.

Figure 8:
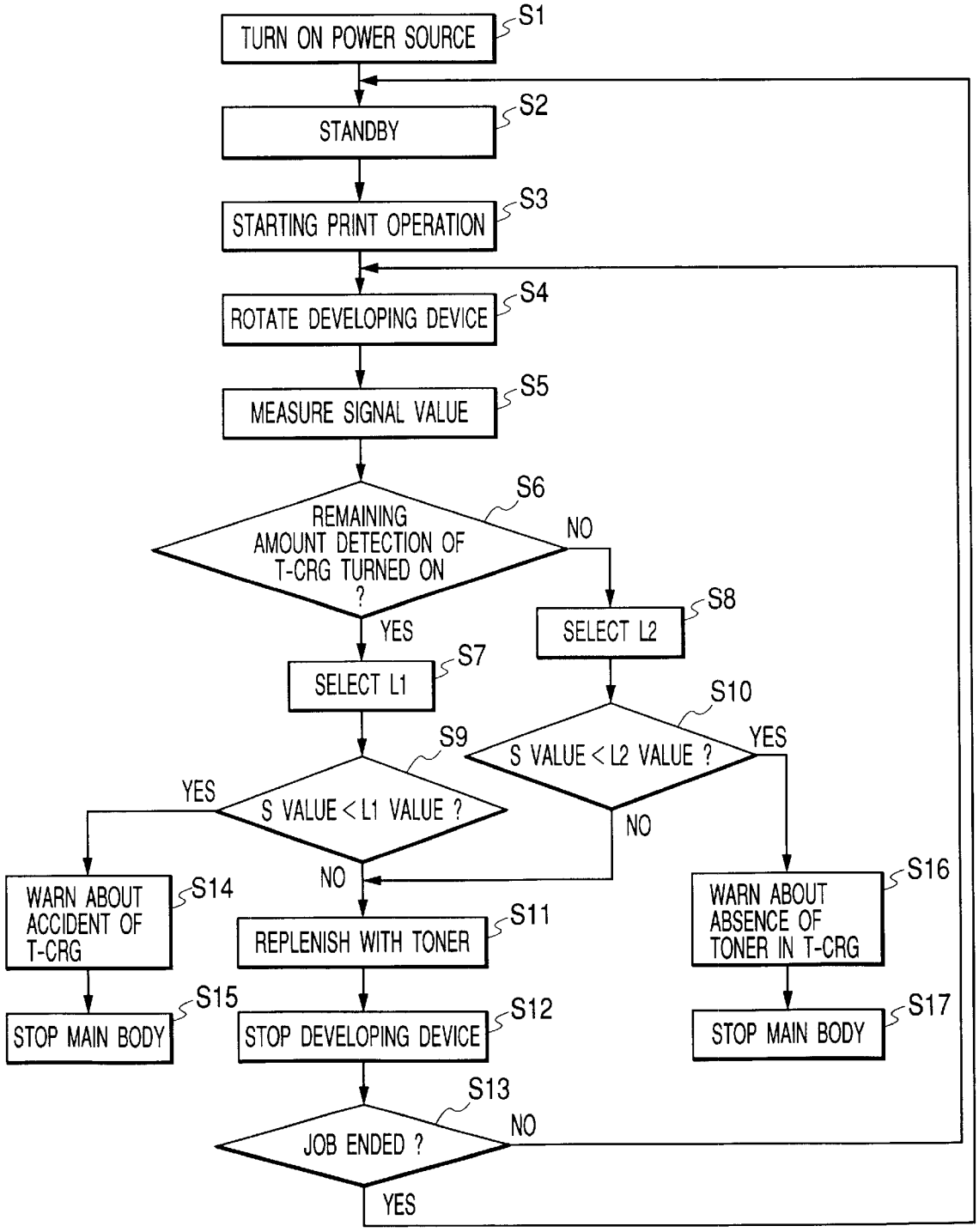
FIG. 8 is a flow chart of Embodiment 2-1 illustrating the operation of the image forming apparatus of the present invention.

FIG. 8 is a flow chart showing the operation of the image forming apparatus regarding the replenishment with the toner.

When a predetermined starting preparation is finished after the power source of the main body of the image forming apparatus has been turned on (s1), a standby state (s2) is brought about. When a print signal is received in the standby state, the printing operation is started and the photosensitive drum 1, the charging apparatus 20, the exposing apparatus 21, etc. are successively started (s3). The developing device 2 stands by while remaining stopped until the timing for developing comes, and the developing device 2 is rotated only when it effects development (s4). Simultaneously with the rotation of the developing sleeve 2A, the screws 5 and 6 in the developing container 10 are rotated to thereby start the agitation of the developer. At a right time when the rotation of the developing device 2 becomes steady, the exposing apparatus 21 is operated to thereby form a latent image and at the some time, the measurement of the density of the developer is effected to thereby obtain a measured value (signal value) S (s5).

Next, reference is had to the remaining toner information of the toner cartridge 9 (s6), and when the remaining amount detection signal is ON, a limit value L1 is selected (s7), and comparison between the measured value S and the limit value L1 is effected (s9), and if the measured value S>the limit value L1, replenishment with the toner is effected as is usual (s11). If the measured value S<the limit value L1, it is judged that the unnatural lowering of the density of the toner in the developing device in spite of the presence of the toner in the toner cartridge 9 means that some inconvenience has occurred to the toner cartridge 9, and the image forming apparatus effects the display of demanding the interchange of the toner cartridge 9 (s14), and stops its operation (s15).

Reference is had to the remaining toner information of the toner cartridge 9 (s6) and when the remaining amount detection signal is OFF, a limit value L2 is selected (s8), and comparison between the measured value S and the limit value L2 is effected (s10), and if the measured value S>the limit value L2, replenishment with the toner is effected as is usual (s11). If the measured value S<the limit value L2, the absence of the toner in the toner cartridge 9 is judged and the image forming apparatus effects the display of demanding the interchange of the toner cartridge 9 (s16), and stops its operation (s17).

After for the measured value S>the limit value L (similar to L1 and L2), replenishment with the toner has been effected as is usual (s11), the developing device 2 is stopped (s12) after the latent image has completely passed the developing device 2, and whether there are remainders of the job is judged (s13), and if there are still sheets to be continuously printed, the image forming apparatus enters the next cycle again, and if there are no remainders of the job, return is made to the standby state (s2).

Figure 9:
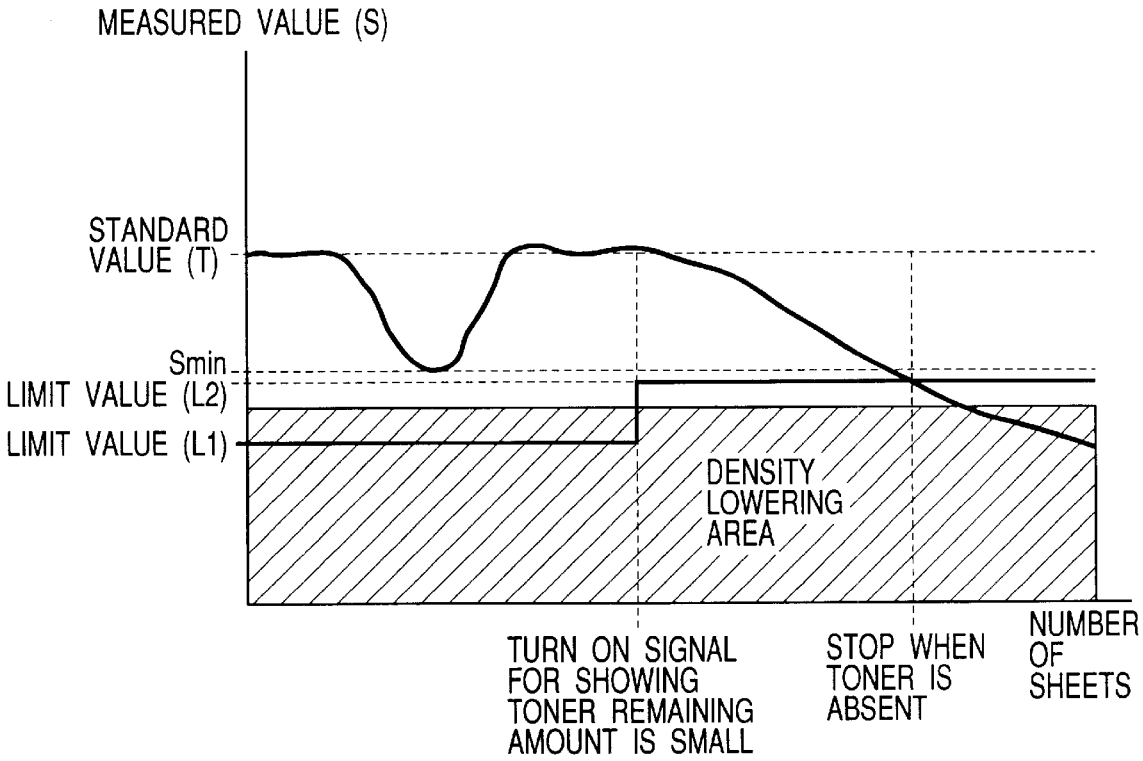
FIG. 9 is an illustration showing the transition of a signal value (measured value) S.

FIG. 9, like FIG. 12 described in the related art, is a graph showing the transition of the measured value S in the above-described construction. As is apparent from FIGS. 9 and 12, in the present embodiment, unlike a case where a constant limit value is always effective, design is made such that the limit value is changed over for use on the basis of the information of the toner cartridge. By doing so, it becomes possible to set the limit value (L2) after the remaining amount detection signal of the toner cartridge has become ON to a little high level, and the lowering of image density and the deterioration of the carrier due to the density of the developer having become too low can be prevented beforehand, and it becomes possible to ensure good images till the last moment when the toner in the toner cartridge becomes absent.

Also, when the remaining amount detection signal of the toner cartridge is OFF, it is originally unnecessary to detect the absence of the toner and therefore, the limit value (L1) can be set to a level lower than the limit value (L2) in order to avoid wrong detection as during the continuous printing of high density images, and if such an inconvenience as the bad rotation or clogging of the replenishing screws should occur to the toner cartridge, the screws can be made to work in order to detect the accident.

As described above, according to the construction of the present invention, design is made such that different limit values are used properly in conformity with the remaining amount of toner in the toner container and therefore, it becomes possible to distinctively judge the absence of the toner in the toner container or the accident of the toner replenishing device or the like, and appropriate warming display is effected, whereby usability is greatly improved. Thus, control partaking both of the accurate detection of the absence of the toner in and the detection of the inconvenience of the toner replenishing device can be realized by a simple construction.

Embodiment 2-2

In Embodiment 2-1, description has been made of an example in which the limit value L is changed over on the basis of the remaining amount detection information of the toner cartridge, and when the measured value S<the limit value L (L1, L2), the absence of the toner in the toner container or the inconvenience of the toner replenishing device or the like is distinctively judged and appropriate warning display is effected.

The present embodiment is a development of Embodiment 2-1, and is characterized in that design is made such that the frequency with which the measured value S<the limit value L has been continuously brought about for the purpose of more highly accurate judgment (hereinafter referred to as the "limit value exceeding frequency Z") is counted, and the accident of or the absence of the toner in the toner cartridge is judged for the first time only when the limit value exceeding frequency Z exceeds 3. In the other points, this embodiment is similar to Embodiment 2-1 and need not be described in detail with regard to those points.

Figure 10:
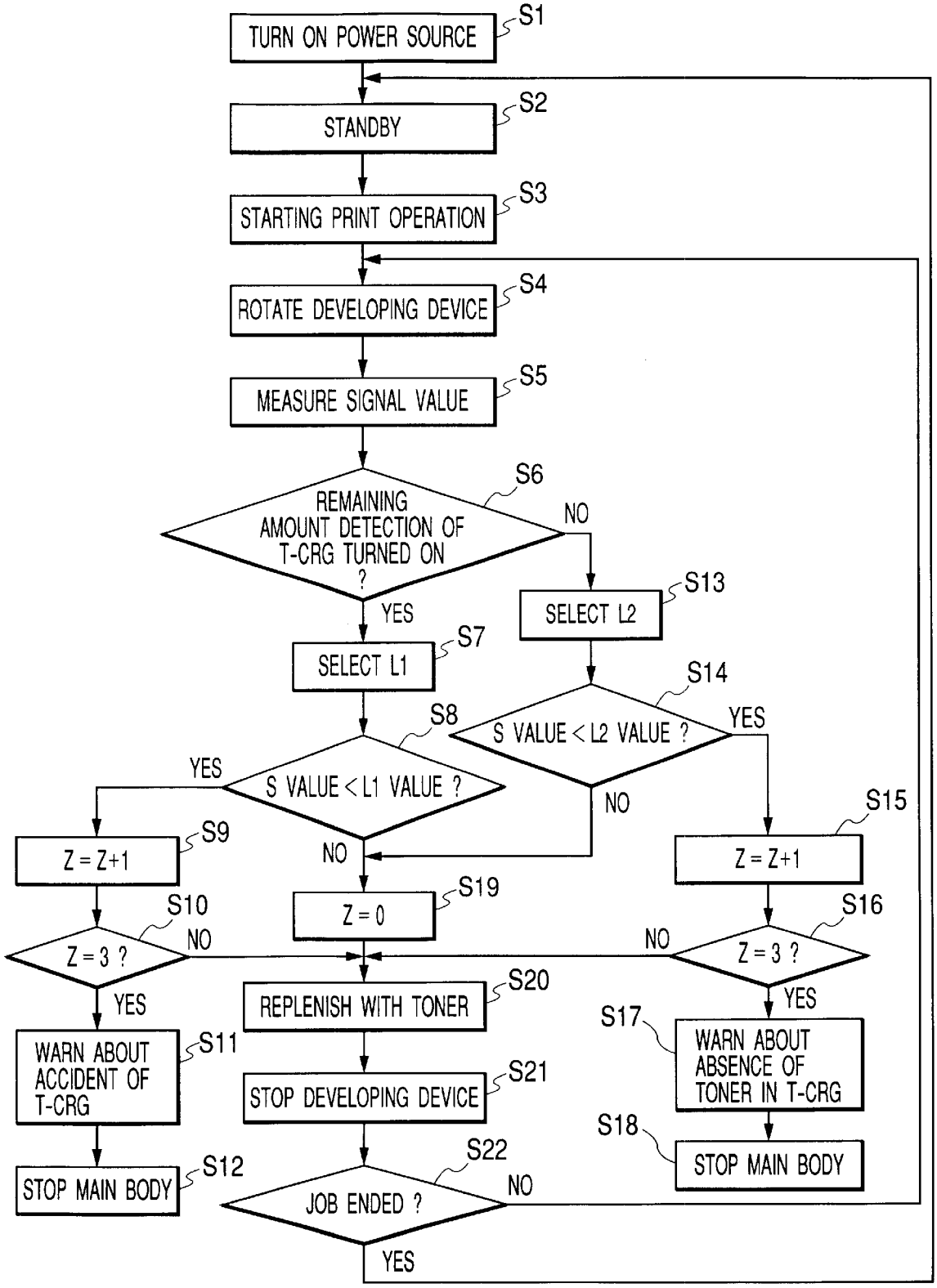
FIG. 10 is a flow chart of Embodiment 2-2 illustrating the operation of the image forming apparatus of the present invention.

FIG. 10 is a flow chart showing the operation of the image forming apparatus regarding the replenishment with the toner in the present embodiment. This flow chart is similar to the flow chart of Embodiment 2-1 up to the points that the power source is turned on (s1) and the measurement of the density of the developer is effected to thereby obtain the measured value S (s5) and therefore, these points need not be described.

After the measured value S has been obtained, reference is had to the remaining toner information of the toner cartridge 9 (s6), and if the remaining amount detection signal is ON, a limit value L1 is selected (s7), and comparison between the measured value S and the limit value L1 is effected (s8), and if the measured value S>the limit value L1, replenishment with the toner is effected as is usual (s20). If the measured value S<the limit value L1, 1 is added to the limit value exceeding frequency Z (s9), and whether the value of Z is 3 or less is judged (s10). If it is 3 or less, the ordinary operation is continued, and when Z=3, it is judged that some inconvenience has occurred to the toner cartridge, and the image forming apparatus effects the display of demanding the interchange of the toner cartridge (s11), and stops its operation (s12).

Reference is had to the remaining toner information of the toner cartridge 9 (s6), and if the remaining amount detection signal is OFF, a limit value L2 is selected (s13), and comparison between the measured value S and the limit value L2 is effected (s14), and if the measured value S>the limit value L2, replenishment with the toner is effected as is usual (s20). If the measured value S<the limit value L2, 1 is added to the limit value exceeding frequency Z (s15), and whether the value of Z is 3 or less is judged (s16). If it is 3 or less, the ordinary operation is continued and when Z=3, the absence of the toner in the toner cartridge is judged, and the image forming apparatus effects the display of demanding the interchange of the toner cartridge (s17), and stops its operation (s18).

If the measured value S>the limit value L (similar to L1 and L2), the limit value exceeding frequency Z is reset to 0 (s19), and replenishment with the toner (s20) is effected as is usual, whereafter the developing device 2 is stopped (s21) after the latent image has completely passed the developing device 2, and whether there are remainders of the job is judged (s22), and if there are still sheets to be continuously printed, the image forming apparatus enters the next cycle again, and if there are no remainders of the job, return is made to the standby state (s2).

Design is made such that by the operation as described above being performed, in a state in which the comparison of the measured value S with the limit value L (similar to L1 and L2) is effected, the next judgment is effected only when the measured value S<the limit value L (similar to L1 and L2) has been judged three times on end and therefore, even if a low value is unexpectedly outputted due to the uneven measurement by the toner density detecting device or the like, it never happens that the apparatus is stopped by mistake, and the factor for the unevenness can be eliminated, and it becomes possible to more precisely judge the accident of and the absence of the toner in the toner cartridge 9.

While in the present embodiment, the limit value exceeding frequency Z is set to 3, this is not restrictive, but Z may be set to other value.

Embodiment 3

Figure 11:
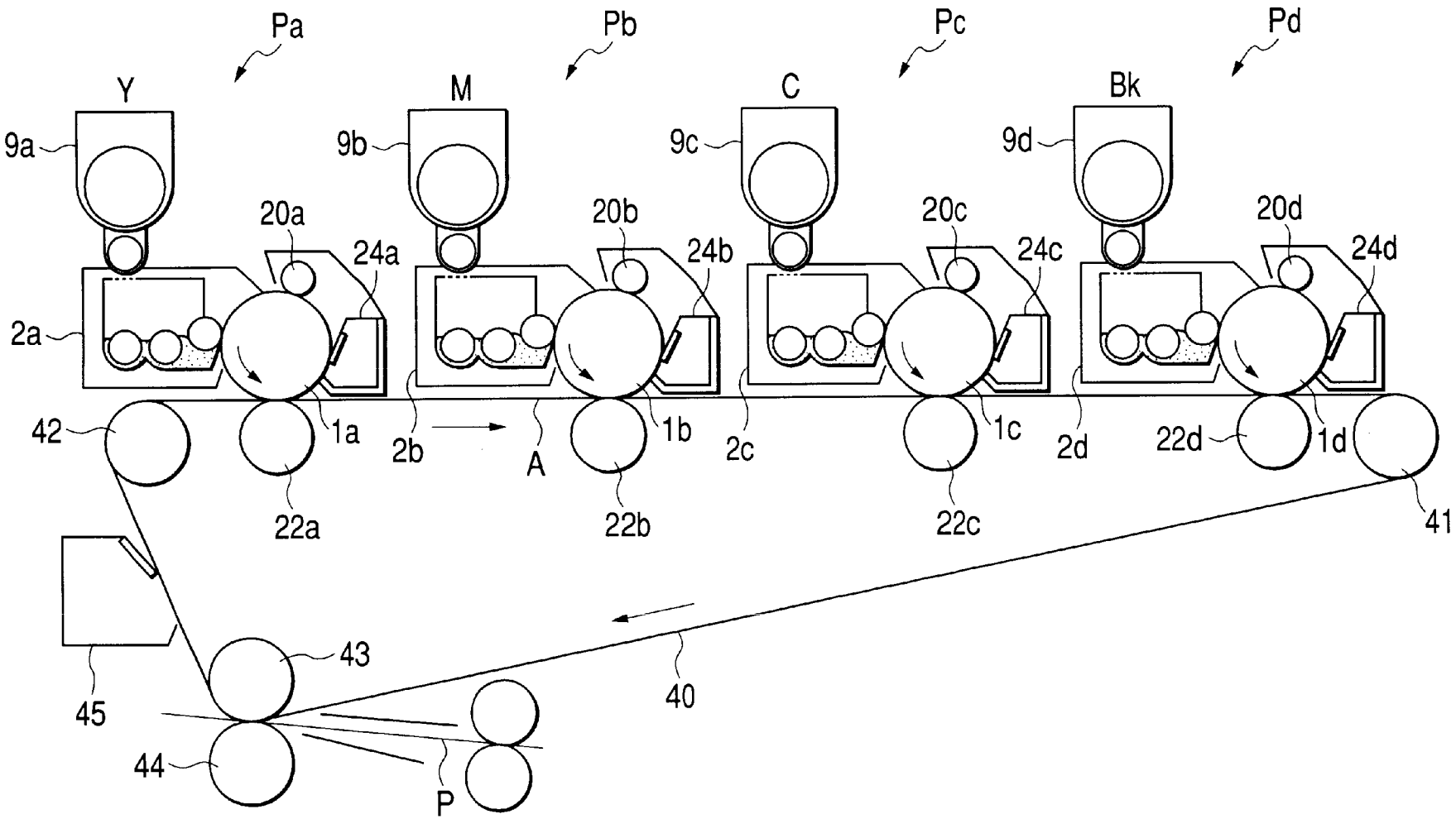
FIG. 11 schematically shows the construction of Embodiment 3 of the image forming apparatus according to the present invention.

FIG. 11 is a schematic cross-sectional view showing the general construction of an electrophotographic color printer according to another embodiment of the present invention. The electrophotographic color printer according to the present embodiment is a four-drum type (in-line) printer having a plurality of image forming portions disposed in parallel and adapting the intermediate transferring method. In the present embodiment, the electrophotographic color printer is provided with a plurality of (in the present embodiment, four) juxtaposed image forming portions Pa, Pb, Pc and Pd, and an intermediate transferring belt 40 is disposed below the image forming portions.

The image forming portions Pa, Pb, Pc and Pd are of the same construction, and in each of the image forming portions Pa, Pb, Pc and Pd, a drum-shaped electrophotographic photosensitive member, i.e., a photosensitive drum 1 (1*a*, 1*b*, 1*c*, 1*d*), as a first image bearing member is rotatably journalled and is rotatively driven in the direction of arrow. A primary charger 20 (20*a*, 20*b*, 20*c*, 20*d*), a developing device 2 (2*a*, 2*b*, 2*c*, 2*d*) and a cleaning apparatus 24 (24*a*, 24*b*, 24*c*, 24*d*) are disposed in opposed relationship with the outer peripheral surface of the photosensitive drum 1 (1*a*, 1*b*, 1*c*, 1*d*) and in the direction of rotation thereof.

By the primary chargers 20*a* to 20*d*, charges of a uniform charging amount are given to the surfaces of the photosensitive drums 1*a* to 1*d*. Then, the photosensitive drums 1*a* to 1*d* are subjected to image exposure by exposing means (such as a color original image color resolving and imaging exposure optical system or a scanning exposure system by laser scan for outputting a laser beam modulated correspondingly to the time-serial electrical digital pixel signal of image information) to thereby form electrostatic latent images.

Further, the electrostatic latent images are visualized by the developing devices 2*a* to 2*d* containing therein developers (hereinafter referred to as the "toners") of four colors such as yellow, magenta, cyan and black. The visualized visible images are transferred to a belt-shaped intermediate transferring member, i.e., an intermediate transferring belt 40, which is a second image bearing member, by transferring rollers 22*a*, 22*b*, 22*c*, 22*d* disposed at primary transferring positions. In this manner, yellow, magenta, cyan and black images are successively superimposed on the intermediate transferring belt 40, whereby a full-color image is formed.

The intermediate transferring belt 40 is passed over a drive roller 41 for transmitting drive to the intermediate transferring belt 40, a driven roller 42 and a secondary transfer opposed roller 43. A primary transfer flat surface A is formed between the drive roller 41 and the driven roller 42. As the intermediate transferring belt 40, use is made, for example, of PET (polyethylene terephthalate), PVDF (polyvinylidene fluoride) or the like. The drive roller 41 comprises a metal roller having its surface coated with rubber (urethane or chloroprene) having a thickness of several millimeters to thereby prevent the slip thereof relative to the belt. The drive roller 41 is rotatively driven by a pulse motor (not shown).

Also, a cleaning apparatus 45 for cleaning the image forming surface of the intermediate transferring belt 40 is disposed downstream of a secondary transfer position at which a transferring roller 44 is disposed in opposed relationship with the secondary transfer opposed roller 43 of the intermediate transferring belt 40.

When an image forming operation starting signal is generated in the image forming apparatus of the above-described construction, the toner image formed on the photosensitive drum 1*a* disposed most upstream with respect to the direction of rotation of the intermediate transferring belt 40 is primary-transferred to the intermediate transferring belt 40 at a primary transfer position by the primary transfer roller 22*a* to which a high voltage has been applied. The primary-transferred toner image is conveyed to the next primary transfer roller 22*b*. There is being effected image formation with a delay of a time for which the toner image is conveyed between the respective image forming portions, and the next toner image is transferred in registered relationship with the preceding image. Thereafter, a similar process is repeated and after all, the toner images of the four colors are primary-transferred onto the intermediate transferring belt 40. Thereafter, a transferring material P comes into the secondary transfer position and comes into contact with the intermediate transferring belt 40, whereupon a high voltage is applied to the secondary transfer roller 44 in timed relationship with the passage of the transferring material P. Thereby, the toner images of the four colors formed on the intermediate transferring belt 40 by the aforedescribed process are transferred to the surface of the transferring material P. Thereafter, the transferring material P is guided to a fixing apparatus (not shown), where the toner images are fixed on the surface of the transferring material P, which is then discharged out of the machine.

On the other hand, in the respective image forming portions Pa to Pd, on the downstream side of the transfer positions, any secondary-untransferred toners not transferred to the intermediate transferring belt 40 but remaining on the photosensitive drums 1*a* to 1*d* are scraped off by the cleaning apparatuses 24*a*, 24*b*, 24*c*, 24*d* to thereby effect the cleaning of the surfaces of the drums, which thus becomes ready for the next image forming process.

Again in such a color image forming apparatus, a toner replenishing device 9 (9*a*, 9*b*, 9*c*, 9*d*) is installed in each developing device 2 (2*a*, 2*b*, 2*c*, 2*d*) used, and a construction similar to that described in Embodiments 1-1, 1-2, 2-1 and 2-2 is adopted, whereby there can be obtained an effect similar to that described in Embodiments 1-1, 1-2, 2-1 and 2-2.

Particularly in the case of the color image forming apparatus, the toners of the four colors are consumed at different speeds and therefore, if the accuracy with which the interchange of the toner cartridges is demanded is bad, much time and labor will be required. However, the control of the present invention which accurately detects the absence of the toner in the toner cartridge and uses up the toner to the last, and yet does not cause poor images till immediately before the apparatus is stopped is also very effective in the color image forming apparatus.

While the invention has been described with reference to the structure disclosed herein, it is not confined to the details set forth and this application is intended to cover such modifications or changes as may come within the purposes of the improvements or the scope of the following claims.

What is claimed is:

1. An image forming apparatus comprising at least one developing device including a developing container for containing therein a developer including a toner and a carrier, means for detecting a density of the developer in said developing container, and a toner replenishing device provided with a toner container containing the toner therein, and for replenishing said developing container with a proper amount of the toner in said toner container, wherein a state in which said developing container is not being replenished with the toner from said toner replenishing device is judged by the density of the developer in said developing container becoming smaller than a predetermined limit value, and wherein said limit value has a plurality of standards, and a value is selected and used in conformity with the remaining amount of toner in said toner container.

2. An image forming apparatus according to claim 1, wherein when the density of the developer in said developing device becomes equal to or less than a limit value (L) a plurality of times on end, a state in which said developing container is not being replenished with the toner from said toner replenishing device is judged.

3. An image forming apparatus according to claim 1, wherein said toner replenishing device is a cartridge detachably mountable to said image forming apparatus.

4. An image forming apparatus according to claim 3, further comprising remaining amount detecting means for detecting a remaining amount of toner in said toner container, and informing means for generating a signal indicative of a small remaining amount of toner when the remaining amount of toner in said toner container becomes equal to or less than a predetermined amount, and wherein when the density of the developer becomes lower than a limit value (L) with the signal indicative of a small remaining amount of toner being outputted, an absence of the remaining amount of toner in said toner container is judged, and a display of demanding an interchange of the cartridge is effected.

5. An image forming apparatus according to claim 3, further comprising remaining amount detecting means for detecting the remaining amount of toner in said toner container, and informing means for generating a signal indicative of a small remaining amount of toner when a remaining amount of toner in said toner container becomes equal to or less than a predetermined amount, and wherein when the density of the developer becomes lower than a limit value (L) with the signal indicative of a small remaining amount of toner being not outputted, an abnormality of said toner replenishing device is judged, and a display of demanding an interchange of the cartridge is effected.

6. An image forming apparatus according to claim 4, wherein after the display of demanding the interchange of said cartridge is effected, an operation of said image forming apparatus is stopped.

7. An image forming apparatus according to claim 3, wherein said cartridge has a nonvolatile memory, and an operating time for replenishing with the toner is integrated and stored in the memory to thereby detect the remaining amount of toner in said toner container.

8. An image forming apparatus according to claim 3, wherein said cartridge has a nonvolatile memory and a toner replenishing screw, and the number of revolutions of said toner replenishing screw is integrated and stored in the memory to thereby detect the remaining amount of toner in said toner container.

9. An image forming apparatus comprising:

a developing container for containing therein a developer including a toner and a carrier;

means for detecting a density of the developer in said developing container;

a developing device including a toner container containing the toner therein, and a toner replenishing device for replenishing said developing container with the toner in said toner container;

comparing means for comparing the density of the developer in said developing container with a predetermined reference value;

remaining amount detecting means for detecting the remaining amount of toner in said toner container;

selecting means for selecting one of a plurality of values which is to be used as said predetermined reference value, in conformity with the remaining amount of toner in said toner container; and toner absence judging means for judging an absence of the remaining amount of toner in said toner container when the density of the developer in said developing container becomes lower than the predetermined reference value selected by said selecting means.

10. An image forming apparatus according to claim 9, further comprising replenishing state judging means for judging that when the density of the developer in said developing device becomes equal to or less than the predetermined reference value once or a plurality of times on end, said developing container is not being replenished with the toner from said toner replenishing device.

11. An image forming apparatus according to claim 9, wherein said toner replenishing device is a cartridge detachably mountable to said image forming apparatus.

12. An image forming apparatus according to claim 11, wherein when the absence of the remaining amount of toner in said toner container is judged, at least one of the display of demanding the interchange of said cartridge and the stoppage of the operation of the image forming apparatus is executed.

13. An image forming apparatus according to claim 9, wherein when in a state in which it is not detected that the remaining amount of toner in said toner container is equal to or less than a predetermined amount, the density of the developer becomes lower than said predetermined reference value, the abnormality of said toner replenishing device is judged.

14. An image forming apparatus according to claim 13, wherein when the abnormality of said toner replenishing device is judged, at least one of the display of demanding the interchange of said cartridge and the stoppage of the operation of the image forming apparatus is executed.

15. An image forming apparatus according to claim 11, wherein said cartridge has a nonvolatile memory, said image forming apparatus further comprises means for integrating an operating time for replenishing with the toner and causing it to be stored in said memory, and said remaining amount detecting means detects the remaining amount of toner in said toner container, based on the operating time for replenishing with the toner stored in said memory.

16. An image forming apparatus according to claim 11, wherein said cartridge has a nonvolatile memory and a toner replenishing screw, said image forming apparatus further comprises remaining amount detecting means for detecting the remaining amount of toner in said toner container, and means for integrating the number of revolutions of said toner replenishing screw and causing it to be stored in said memory, and said remaining amount detecting means detects the remaining amount of toner in said toner container, based on the number of revolutions of the toner replenishing screw stored in said memory.

17. An image forming apparatus including at least one developing device having a developing container for containing therein a developer having a toner and a carrier, means for detecting a density of the developer in said developing container, and a toner replenishing device provided with a toner container containing the toner therein, and for replenishing said developing container with a proper amount of the toner in said toner container, said toner replenishing device being a cartridge detachably mountable to the image forming apparatus, wherein by the density of the developer in said developing container becoming smaller than a predetermined limit value, the absence of the toner in said toner container is judged, comprising:

remaining amount detecting means for detecting the remaining amount of toner in said toner container; and informing means for generating a signal indicative of a small remaining amount of toner when the remaining amount of toner in said toner container becomes equal to or less than a predetermined amount;

said limit value being effective only in a state in which the signal indicative of a small remaining amount of toner is being outputted.

18. An image forming apparatus according to claim 17, wherein when in a state in which the limit value is effective, the density of the developer in said developing device becomes equal to or less than the limit value a plurality of times on end, the absence of the toner in said toner container is judged.

19. An image forming apparatus according to claim 17, wherein after the absence of the toner in said toner container is judged, the display of demanding the interchange of the cartridge is effected.

20. An image forming apparatus according to claim 17, wherein after the display of demanding the interchange of said cartridge is effected, the operation of the image forming apparatus is stopped.

* * * * *

UNITED STATES PATENT AND TRADEMARK OFFICE

CERTIFICATE OF CORRECTION

PATENT NO. : 6,640,060 B2
DATED : October 28, 2003
INVENTOR(S) : Seiji Yamaguchi et al.

It is certified that error appears in the above-identified patent and that said Letters Patent is hereby corrected as shown below:

Column 2,
Line 25, “How” should read -- how --.

Column 3,
Line 18, “is” should read -- it --.

Column 5,
Line 20, “becomes” should read -- become --.

Column 10,
Line 31, “he” should read -- the --.

Signed and Sealed this

Fifteenth Day of June, 2004

JON W. DUDAS
*Acting Director of the United States Patent and Trademark Office*